United States Patent [19]

Desaar

[11] 4,097,030

[45] Jun. 27, 1978

[54] LANCE FOR DESULPHURIZING CAST IRON OR STEEL

[76] Inventor: René Desaar, Rue Michel Body, 67, 4330 Grace-Hollogne, Belgium

[21] Appl. No.: 757,533

[22] Filed: Jan. 7, 1977

[30] Foreign Application Priority Data

| | | |
|---|---|---|
| Jan. 7, 1976 | Belgium | 45320 |
| Dec. 17, 1976 | Belgium | 45792 |

[51] Int. Cl.[2] ..... C21C 5/32

[52] U.S. Cl. ..... 266/225

[58] Field of Search ..... 266/201, 216, 217, 220, 266/225, 226, 233, 235; 239/132.1, 132.3

[56] References Cited

U.S. PATENT DOCUMENTS

| | | | |
|---|---|---|---|
| 2,805,147 | 9/1957 | Schreiber | 266/217 |
| 3,615,085 | 10/1971 | Bernsmann | 266/225 |

*Primary Examiner*—Gerald A. Dost

*Attorney, Agent, or Firm*—Sughrue, Rothwell, Mion, Zinn and Macpeak

[57] ABSTRACT

A refractory sleeve terminating in a refractory head surrounds an injection pipe for injection of a desulphurizing agent under gas pressure into cast iron or steel and forms with the injection pipe a cooling chamber closed at its lower and lateral parts. A plurality of cooling air inflow pipes extend from a distributor case overlying the refractory sleeve through the cooling chamber in a circumferential array parallel to the injection pipe with the ends of the pipe facing the closed bottom of the chamber open to effect discharge of very cool air in the vicinity of the refractory head with the cooling air escaping upwardly within the chamber about the inflow pipes to cool the injection pipe and the refractory sleeve prior to escaping from the sleeve at the top.

7 Claims, 8 Drawing Figures

FIG. 1
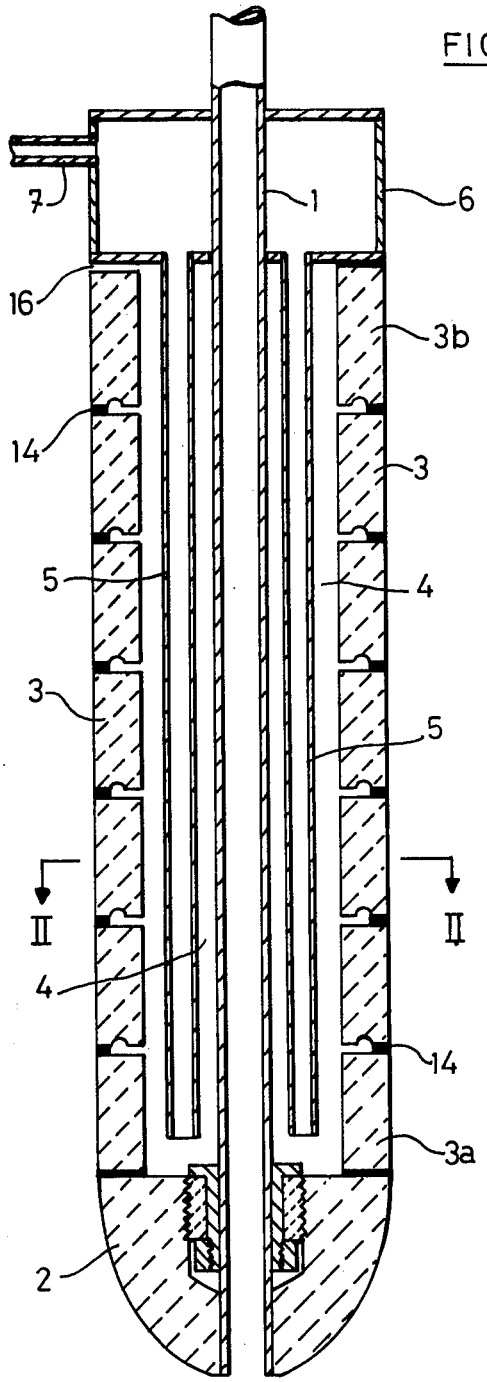
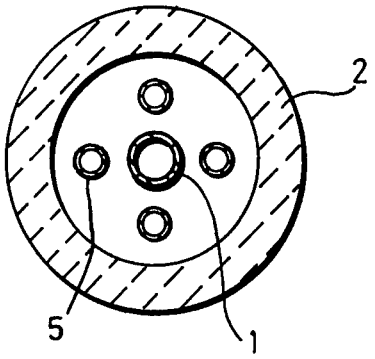
FIG. 2

LANCE FOR DESULPHURIZING CAST IRON OR STEEL

The present invention relates to a lance for desulphurising cast iron or steel.

Materially, the desulphurising lance essentially comprises a metal injection pipe protected laterally by a refractory material sheath. In operation, the injection lance is intended to be immersed partially into a bath of cast iron or steel for injecting into the same at least one desulphurising agent carried through a metal injection pipe by a gas flow.

In the known desulphurising lances, the injection pipe is covered by a refractory material sheath formed from a fireclay applied directly on its external surface and extending uninterruptedly throughout its length.

In other known desulphurising lances, the injection pipe is ringed by refractory material collars from its lower extremity to its upper part. These collars are installed with little play around the injection pipe, so that the space present between this pipe and these collars simply serves the purposes of installing the desulphurising lance.

As a result, all the known desulphurising lances lack an effective cooling means apt to prevent their rapid deterioration by deformation or warping of the injection pipe or by rapid attack of the refractory material. The known desulphurising lances thus render it possible to process no more than a particularly small number of batches which should be desulphurised. Becuase of this fact, the cost price of the desulphurising operation is very high per ton of steel, with the known desulphurising lances. On the other hand, the known desulphurising lances require the use of labour for their frequent repairs. As a consequence of the attack of the slag on the refractory material sheath, the known desulphurising lances are frequently sectioned during the desulphurising action whilst they are immersed into the metal bath, which has the result of spoiling the desulphurisation of the liquid alloy.

The invention has as its object a novel desulphurising lance which allows of obviating the shortcomings of the known cases, and in particular assures a distinctly greater number of desulphurised batches than that of these known cases.

To this end, a desulphurising lance in accordance with the invention comprises a downwardly closed off annular chamber traversed in upward direction from below by a flow of cooling gas between the metal injection pipe and the refractory material sheath during operation. The cooling gas flow ensures the cooling of the injection pipe and of the refractory material sheath during the desulphurising operation.

To establish the upward cooling gas flow from below in the novel desulphurising lance, the annular chamber is equipped with at least one cooling gas feed pipe in its lower portion. In practice, the annular chamber comprises several cooling gas feed pipes which are connected at the top to a cane distributing this gas, which is installed around the injection pipe above the refractory material sheath. The feed pipes extend parallel to the injection pipe and open close to the bottom of the annular chamber.

So that the cooling of the component parts of the novel desulphurising lance may be particularly effective, the annular chamber comprises two concentrical compartments separated by an intermediate pipe coaxial with the injection pipe. The intermediate steel pipe is suspended from the lance-carrier mechanism via a ring which is welded to its upper part and which is secured on the casing of the suspension system of the lance-carrier mechanism. In practice, the feed pipes extend into the inner compartment and open close to the bottom to feed the cooling gas in at the same. The discharge of the cooling gas occurs via apertures incorporated in the upper portion of the intermediate pipe. Other feed pipes may also extend between the former within the inner compartment and may, close to the bottom and at half height, have connectors traversing the intermediate pipe to allow of the injection of the cooling gas into the outer compartment in this manner.

In accordance with a structural feature of the novel desulphurising lance, an annular metal plate is secured to the base of the intermediate pipe.

To withstand thermal stresses in higher degree, the lower portion of the injection pipe of the novel desulphurising lance is protected by a lance nose-cone of refractory material. The lance nose-cone is screwed on to a refractory material sleeve which is held in position by a metal nut. This nut itself is protected by the lance nose-cone and is screwed on to a metal bushing screw-threaded at its lower extremity and welded at its upper part on to the annular plate. Moreover, the lance nose-cone and the annular plate delimit a lower annular chamber which is supplied with cooling gas via feed pipes whereof the preferably necked-down lower extremity traverses this annular plate, and which is in communication with the outer compartment of the upper annular chamber via at least one aperture formed between this same annular plate and the refractory material sheath. The cooling gas emerges from the lower annular chamber and penetrates into the aforesaid outer compartment via the aperture in question.

If the refractory material sheath comprises superposed collars, and to thrust these resiliently against each other and the bottom one against the lance nose-cone, a coil spring applied against the top collar is incorporated in the novel desulphurising lance. The space between the turns of the coil spring forms the discharge aperture of the cooling gas flowing in the outer compartment of the upper annular chamber.

In accordance with a material feature of the novel desulphurising lance, a case is incorporated for collecting the cooling gas flow coming from the aforesaid annnular chamber. The collector case comprises nozzles for outflow of this gas flow to direct gas jets towards the opening of a cover applicable during operation of the upper rim of the ladle. During operation, this opening is traversed by the desulphurising lance. This feature has the double advantage of preventing the clogging of the opening of the cover intended for passage of the lance and that of the lower surface of this cover. As a matter of fact, the gas jets blown in from the collector case via the opening of the cover downwardly drive and cool the splashes of metal and of scoria which otherwise reach this opening and settle on its sidewall to reduce its passage cross-section progressively. Beyond this, the gas jets penetrating into the ladle covered by the cover form a relatively cold gas cushion beneath this latter. In this manner, the splashes of metal or of scoria which pass through this gas cushion are cooled down sufficiently to be unable thereupon to adhere to the lower refractory surface of the cover upon impinging on this surface.

In the novel desulphurising lance, the collector case is advantageously installed on the intermediate pipe and collects the cooling gas issuing from the upper apertures of this intermediate pipe.

Other details and features of the invention will become apparent in the course of the description and from the drawings attached to the present statement, and which illustrates several forms of embodiment of the invention diagrammatically and solely by way of example.

FIG. 1 is a vertical axial cross-section of a first form of embodiment of a desulphurising lance in accordance with the invention.

FIG. 2 is a cross-section of the desulphurising lance taken along the line II—II of the preceding figure.

In these different figures, analogous reference notations denote identical elements.

Figure 3:
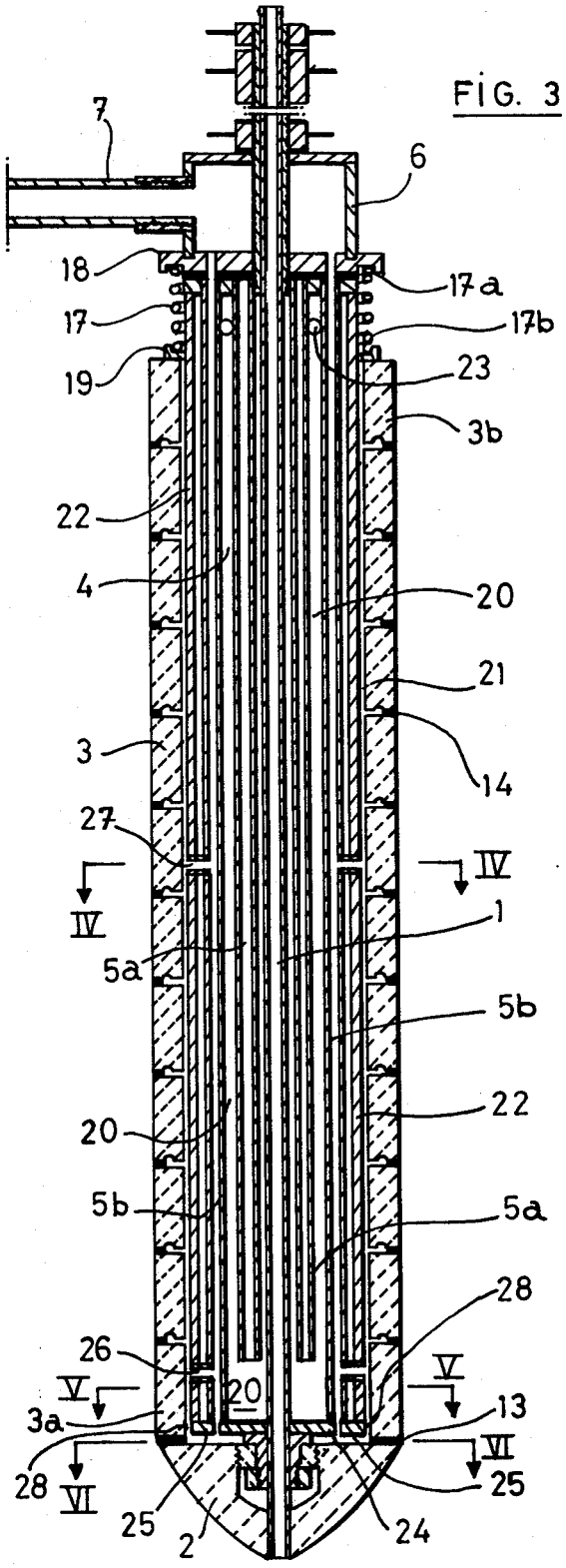
FIG. 3 is an analogous axial cross-section of a more highly developed second form of embodiment of the desulphurising lance in accordance with the invention.
Figure 4:
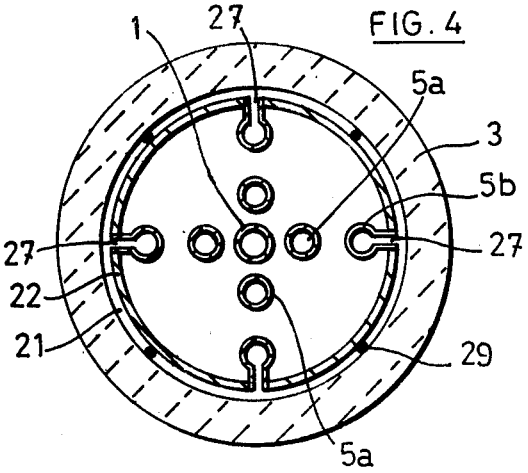
FIGS. 4, 5 and 6 are cross-sections of the second desulphurising lance, taken along the lines IV—IV, V—V and VI—VI of the third figure.
Figure 6:
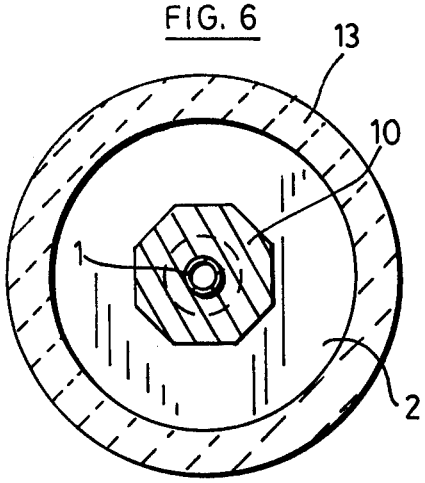
Figure 5:
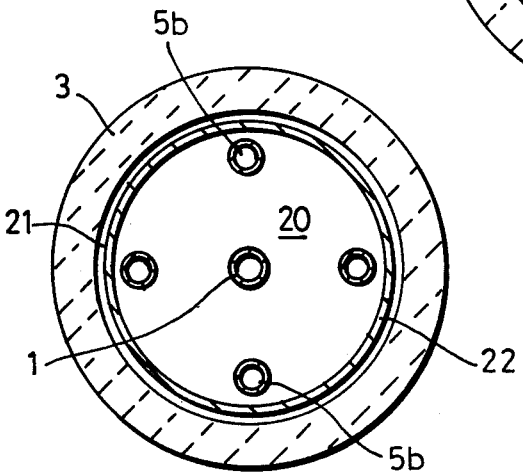

The desulphurising lance in accordance with the invention serves the purpose of injecting at least one desulphurising agent into a bath of cast iron or steel contained within a casting ladle. The desulphurising agent commonly consists of calcium carbide in powder form and is entrained by a flow of anhydrous air.

The desulphurising lance is suspended from a beam in manner known per se and is displaceable above the ladle containing the metal bath which is to be desulphurised, under the action of a hoist carried by the beam.

Materially, the desulphurising lance comprises an injection pipe 1 traversed by the desulphurising agent and its entraining gas flow. The injection pipe 1 is equipped at the bottom with a protective lance nose-cone 2 of refractory material and is protected laterally by a sheath 3 which is equally of refractory material.

The feed of desulphurising agent and of entraining gas to the injection pipe 1 is assured by conventional means.

The refractory material sheath 3 essentially comprises superposed collars but could be formed by a refractory fireclay applied on a tubular bearer surrounding the injection pipe 1.

In accordance with the main inventive principle, the desulphurising lance essentially comprises an annular chamber 4 situated between the injection pipe 1 and the refractory material sheath 3, above the nose-cone 2. The chamber 4 serves the purpose of upwardly ducting from below a flow of cooling gas apt to cool the injection pipe 1, the lance nose-cone 2 and the refractory material sheath 3, at the same time. The gas applied for this cooling action is dry or damp air, for example.

To assure the infeed of the cooling gas into the lower part of the chamber 4, the desulphurising lance essentially comprises feed pipes 5 extending parallel to the injection pipe 1. The lower extremities of the feed pipes 5 are situated close to the nose-cone 2, whereas the upper extremities of these pipes 5 are connected to a distributor case 6. The distributor case 6 hermetically enflanks the injection pipe 1 above the refractory material sheath 3. The supply of cooling gas to the distributor case 6 is provided by means of a, for example lateral, feed pipe 7.

Figure 7:
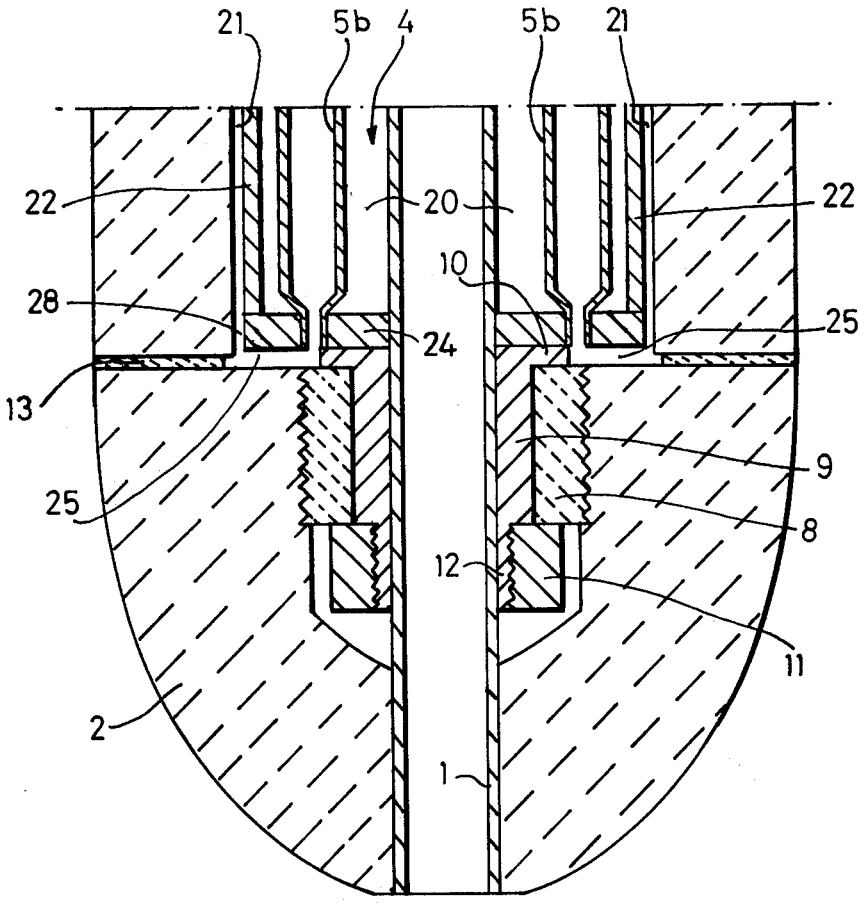
FIG. 7 is an axial cross-section of the lower part of the second desulphurising lance.
Figure 8:
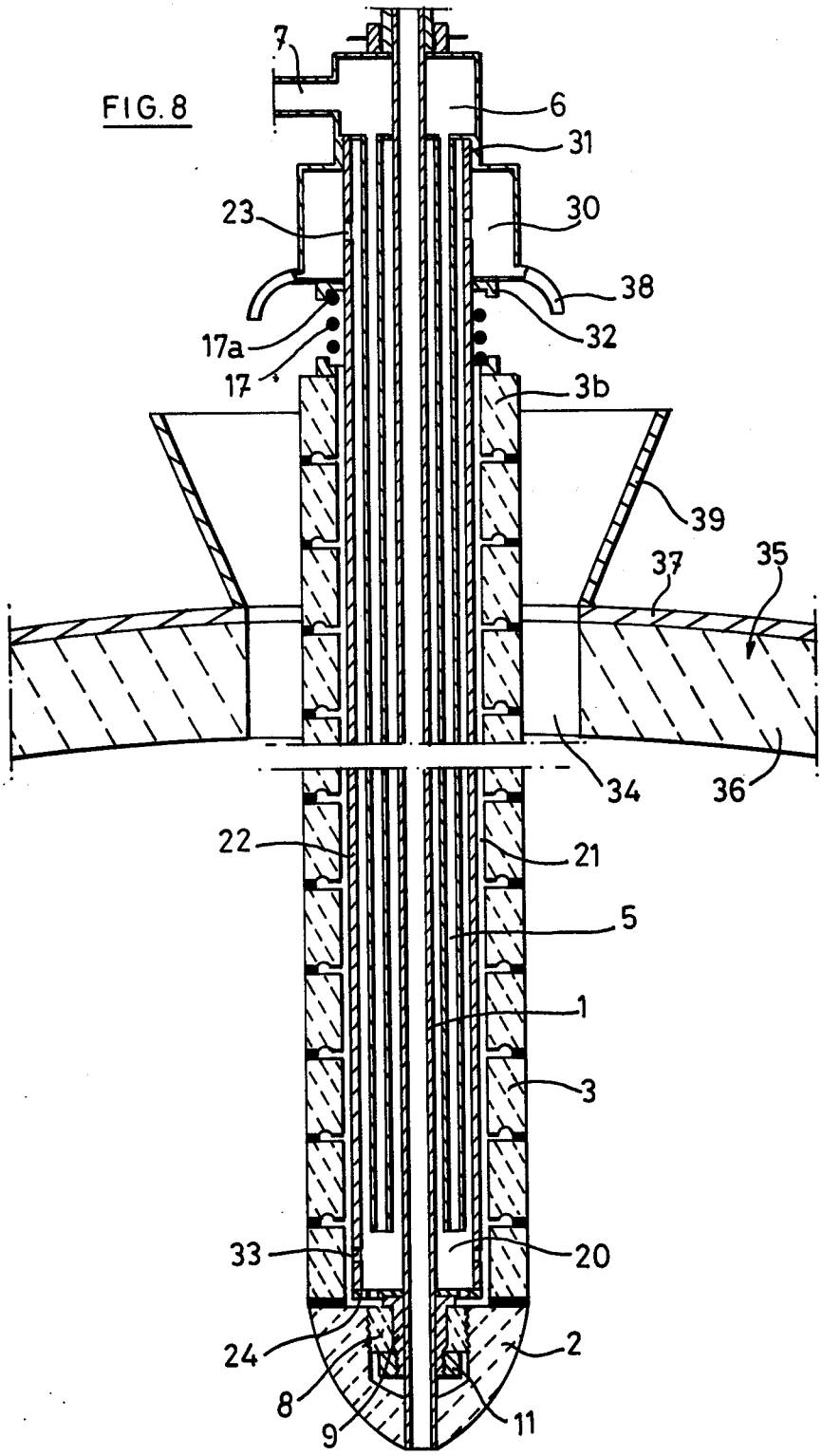
FIG. 8 is a vertical axial cross-section of a third form of embodiment of a desulphurising lance in accordance with the invention.

As shown in FIG. 7, the nose-cone 2 is internally screw-threaded in its upper portion. Owing to this fact, the nose-cone 2 is screwed over a screw-threaded sleeve 8 of refractory material positioned on a metal nozzle 9 which for its part is installed on the injection pipe 1. The screw-threaded sleeve 8 is secured axially on the nozzle 9 between the upper flange 10 of this latter and a metal nut 11 screwed on the lower screw-threaded part 12 of this nozzle 9.

In each case considered, in which the refractory material sheath 3 comprises superposed collars, the lower refractory material collar 3*a* rests on the lance nose-cone 2 via a bottom sealing joint 13, for example of asbestos, whereas the others are separated in each case by an analogous intermediate sealing joint 14.

In the first form of embodiment illustrated, the refractory material sheath 3 extends practically throughout the height separating the nose-cone 2 and the distributor case 6. As a matter of fact, the upper refractory material collar 3*b* is adjacent to the bottom of the distributor case 6 and is separated from the same solely by a top sealing joint 15, for example of neoprene.

On the other hand, in the first example, the chamber 4 forms a single compartment and comprises feed pipes 5, which are all identical, spread evenly around the injection pipe 1. The cooling gas is consequently injected into the chamber 4 close to the lance nose-cone 2 and rises in this chamber 4 whilst flowing along the outer surface of the injection pipe 1 and the inner surface of the refractory material collars. The cooling gas emerges from the chamber 4, for example through exhaust openings 16 which are preferably incorporated between the bottom of the distributor case 6 and the upper refractory material collar 3*b* and which are distributed evenly around the injection pipe 1.

The cooling gas flowing in the chamber 4 assures the cooling of the injection pipe 1, which consequently remains rigid, as well as that of the refractory material sheath 3 and of the nose-cone 2 which are thus exposed to less degradation under the action of the thermal stresses they undergo upon immersion of the lance in the metal bath.

In the second form of embodiment illustrated (FIG. 3), the collars of the refractory material sheath bear resiliently against each other and on the nose-cone 2, with insertion between them of bottom 13 and intermediate 14 sealing joints. To this end, the refractory material collars are loaded by a coil spring 17 situated between the distributor case 6 and the upper refractory material collar 3*b*. The upper turn 17*a* of the spring 17 is housed within a circular groove formed in an annular metal plate 18 forming the bottom of the distributor case 6. The lower turn 17*b*, for its part, is housed in a circular groove of a metal ring 19 resting on the upper collar 3*b*. After being installed, the turns of the spring 17 remain spaced apart from each other.

In this second form of embodiment, the chamber 4 has two conventrical compartments around the injection pipe 1, the inner one 20 being adjacent to this injection pipe 1 and the outer one 21 being contiguous to the refractory material sheath 3.

The two compartments, that is to say the inner chamber 20 and the outer chamber 21, are radially delimited by an intermediate pipe 22 which is suspended from the lance-carrier mechanism via an annular plate welded to the upper portion of this intermediate pipe 22 and secured to the sleeve of the suspension system of this lance-carrier mechanism.

The inner chamber 20 is in communication with the surrounding atmosphere via upper orifices 23 which are incorporated in the upper part of the intermediate pipe 22, above the refractory material sheath 3. The inner chamber 20 is downwardly delimited by an annular metal plate 24 which is secured to the base of the intermediate pipe 22 and to which is welded the upper flange 10 of the aforesaid nozzle 9.

During operation, the inner chamber 20 is traversed by a cooling gas flow which during its upward displacement serves the purpose of cooling the injection pipe. The cooling gas is ducted into the lower part of the inner chamber 20 via feed pipes 5*a* analogous to those of the first form of embodiment. The feed pipes 5*a* are consequently joined at the top to the bottom of the distributor case 6. The feed pipes 5*a* also extend downwards parallel to the injection pipe 1 as far as a small distance from the lower plate 24.

The cooling gas which traverses the inner chamber 20 is heated up relatively little upon issuing through the upper orifices 23 via which it passes into the ambient emvironment.

The outer chamber 21 is also traversed during operation by another much smaller flow of the same cooling gas serving the purpose of cooling the nose-cone 2 and the refractory material collars effectively. The outer chamber 21 is supplied with cooling gas via feed pipes 5*b* having preferably the same diameter as the preceding ones 5*a*. As a matter of fact, the feed pipes 5*b* are installed parallel to the injection pipe 1 and to the pipes 5*a* whilst being distributed evenly between these latter. Each feed pipe 5*b* extends throughout the height of the inner chamber 20. The upper extremity of each feed pipe 5*b* is connected to the distributor case 6 whereas the lower extremity of the feed pipe 5*b* opens into a lower annular auxiliary chamber 25 delimited essentially by the nose-cone 2, the bottom plate 24 and the bottom sealing joint 13. Each feed pipe 5*b* is in communication with the outer chamber 21 on the one hand, in its lower part, via lower connectors 26, and on the other hand in its middle part, via via analogous middle connectors 27, the connectors 26 and 27 traversing the intermediate pipe 22.

The lower auxiliary chamber 25 is in constant communication with the outer chamber 21 via an annular slot 28 situated between the lower plate 24 and the lower refractory material collar 3*a*.

During operation, the cooling gas which flows in each feed pipe 5*b* is distributed in this manner, on the one hand into the outer chamber 21 via the connectors 26 and 27, and on the other hand into the lower auxiliary chamber 25 via the necked-down lower extremity of this pipe 5*b*. A first part of the flow of cooling gas is thus injected powerfully into the lower auxiliary chamber 25, on to the nose-cone 2 to cool the same intensively, and thereupon rises again in the outer chamber 21. At the level of the lower connectors 26, an as yet still cold part of this flow passes into the outer chamber 21 and is added to the first part to cool the refractory material collars 3 whilst rising again. At the level of the middle connectors 27, an as yet still cold third part of the same flow, reaches the outer chamber 21 and is also added to the two preceding ones to continue to cool the refractory material collars 3. In the upper part of the outer chamber 21, the cooling gas flow co-ordinated with the same is exhausted into the ambient environment between the turns of the spring 17. It should be noted that the annular cross-section of the outer chamber 21 is distinctly smaller than that of the inner chamber 20, so that for substantially equal rates of flow, the cooling gas flows much more rapidly throgh this outer chamber 21 than through the other 20. So great a difference between the speeds of flow of the cooling gas renders it possible to cool the refractory material collars 3 and the nose-cone 2 more intensively than the injection pipe 1, these refractory material elements 2 and 3 being exposed to much greater thermal stresses moreover during operation than the metal element 1.

It should be observed that the intermediate pipe 22 for separation of the inner 20 and outer 21 chambers is held equidistant from the refractory material collars 3, for example by steel wires 29 spot-welded to the outer surface of this intermediate pipe 22.

In the third form of embodiment illustrated, the lance cooling chamber still comprises two concentrical compartments, being the inner chamber 20 and the outer chamber 21, delimited radially by the intermediate pipe 22.

In this third case, a collector case 30 is incorporated around the intermediate pipe 22 between the distributor case 6 and the upper collar 3*b* of the refractory material sheath 3. The distributor case 6 is installed on the injection pipe 1 and is secured thereon by the retaining nut as in the second case. The collector case 30 surrounds the upper openings 23 of the intermediate pipe. The collector case 30 is kept spaced apart from the distributor case 6 by a spacing ring 31. The collector case 30 acts as a support for a grooved plate 32 acting as a retainer for the top turn 17*a* of the coil spring 17.

In the third example, the flow of the cooling gas is still divided in the feed pipes 5 and allowed to enter the lower part of the inner chamber 20 close to the nose-cone 2. From the same, the cooling gas flow is divided into two parts. The very substantial first part rises in the inner chamber 20 between the injection pipe 1 and the intermediate pipe 22 and issues from this chamber 20 via the upper openings 23 of this pipe 22 to penetrate into the collector case 30. The much smaller second part passes into the outer chamber 21 via lower openings 33 of the intermediate pipe 22. This second part rises in the outer chamber 21 between the intermediate tube 22 and the refractory material sheath 3 and issues from this chamber 21 between the separated turns of the coil spring 17 to pass into the external environment.

In this way, the greater part of the cooling gas flow is recovered in the collector case 30. This recovered part of the cooling gas primarily serves the purpose of keeping the passage opening 34 of the desulphurising lance open, said opening being formed in a cover 35 which may be applied during operation on the top rim of the ladle and, complementarily, of effectively protecting the refractory lining 36 of this cover, installed on a superjacent steel framework 37.

To this end, gaseous air jets are discharged from the collector case 30 via the small pipes 38 which are downwardly bent and welded to the lower part of this case 30. The jets of air are directed towards the opening 34 along the refractory material sheath 3. The jets of air are collected by an upwardly flared frustoconical plate 39 which is welded to the framwork 37 around the opening 34. In this way, the jets of air are impelled to pass through the opening 34 of the cover 35 and to penetrate into the ladle covered by this latter.

As a result, the splashes of metal or scoria spurting upwards in the course of desulphurisation are driven out of the passage of the opening 34 by the aforesaid jets of air. On the other hand, thanks to the relatively cold air cushion formed below the cover 35 within the ladle, these splashes are cooled sufficiently so that can no longer adhere to the refractory lining 36 of the cover 35 upon impinging on this lining 36. This results in a lack of obstruction of the opening 34 and a lack of deposit of slag on the lining 36 of the cover 35 whereof the range of application is thus much wider, all other circumstances being equal.

It is obvious that the invention is not limited solely to the forms of embodiment illustrated and that numerous modifications may be made in the form, arrangement and structure of some of the elements playing a part in its embodiment, subject to the condition that these modifications are not at odds with the object of each of the following claims.

What is claimed is:

1. A desulphurizing lance for desulphurizing cast iron or steel comprising:

an injection pipe, means for connecting the injection pipe with a source of desulphurizing agent and with a source of pressurized gas for carrying the desulphurizing agent through said injection pipe, a refractory sleeve consisting of superposed refractory rings mounted about the injection pipe, a refractory head enclosing the lower part of the injection pipe below the refractory sleeve, a distributor case attached to the injection pipe at the end remote from the refractory head and hermetically enclosing said injection pipe about the refractory sleeve, means for connecting the distributor case to a source of compressed air, tightening means mounted between the distributor case and the refractory sleeve for resiliently pressing the refractory rings, one on top of the other, against the refractory head, an annular cooling chamber closed at its lower and lateral parts and defined by the injection pipe, the refractory sleeve and the refractory head, a plurality of inflow pipes connected to the distributor case at the bottom thereof and extending within the cooling chamber in a circumferential array parallel to the injection pipe as far as the lower part of the annular cooling chamber, said inflow pipes having open ends facing the closed lower part of said chamber, and at least one discharge opening for the annular cooling chamber provided between the distributor case and the refractory sleeve at the top of said chamber such that cooling air flows after being introduced via the distributor case and the inflow pipes rapidly into the lower part of the annular cooling chamber to immediately cool the refractory head, upwardly about the inflow pipes and within the refractory sleeve, to cool the injection pipe and the refractory sleeve upon rising within the chamber with said heated air flow discharging through the cooling chamber discharge opening.

2. The desulphurizing lance as claimed in claim 1, wherein an intermediate pipe is mounted within said annular cooling chamber coaxially with the injection pipe and extending the entire length of the chamber with said intermediate pipe dividing the annular cooling chamber into two concentric compartments, constituting an inner compartment and an outer compartment, said intermediate pipe comprising at its lower part a plurality of openings for communicating the two compartments with one another, said inflow pipes being disposed at least within said inner compartment such that cooling air flow is introduced on one hand into the inner compartment to cool the injection pipe during air flow ascent therein and on the other hand to a minor extent by way of air passage between said intermediate pipe and said refractory sleeve to cool said refractory sleeve.

3. The desulphurizing lance as claimed in claim 2, wherein said refractory head is screwed onto said refractory sleeve by a metal screw which is thermaly protected by said head, said screw being screwed into a metal nozzle screw-threaded at its lower end and welded at its upper end to an annular metal disc rigidly connected to the lower end of said intermediate pipe.

4. The desulphurizing lance as claimed in claim 3, wherein said annular metal disc attached to the lower end of the intermediate pipe defines with the refractory head a lower annular cooling chamber, said lower annular cooling chamber being supplied with cooling air from said inflow pipes with the lower ends of said inflow pipes passing through the annular disc and discharging into the lower chamber, said annular disc and the lower part of the refractory sleeve forming between them at least one opening for communicating the lower chamber and the outer compartment such that the cooling air flows penetrating the lower chamber cool the refractory head and then are discharged into the outer compartment by way of the corresponding passage opening.

5. The desulphurizing lance as claimed in claim 1, wherein said tightening means for said refractory rings to comprise a helicoidal spring mounted between the uppermost refractory rings of said refractory sleeve and said distributor case such that the space between the coils of the helicoidal spring constitute the upper discharge opening for discharging the cooling air flow from the annular cooling chamber, and wherein sealing joints are provided between the rings and between the lower ring and the refractory head.

6. The desulphurizing lance as claimed in claim 1, further comprising a collector case for collecting the cooling air flow emanating from the annular cooling chamber, said collector case comprising discharge pipes for directing air jets about the outside of said refractory sleeve in a direction parallel to the axis of said sleeve such that in use the air jets are directed through an opening of a cover which may be applied during operation on the top rim of the ladle with said opening being traversed by the desulphurizing lance.

7. The desulphurizing lance as claimed in claim 6, further comprising means for hermetically sealing the collector case to the intermediate pipe, and wherein said means for collecting cooling air issuing from the upper openings of the intermediate pipe constitutes openings for discharging the air from the inner compartment of the annular cooling chamber into said collector case.

* * * * *